US012708977B2

(12) United States Patent
Cole et al.

(10) Patent No.: US 12,708,977 B2
(45) Date of Patent: Aug. 18, 2026

(54) GRINDING MACHINE FORMING A TRENCH

(71) Applicant: CORNING RESEARCH & DEVELOPMENT CORPORATION, Corning, NY (US)

(72) Inventors: Brian Matthew Cole, Austin, TX (US); David Montalion Dupuis, Cedar Park, TX (US); Cary Alan Kipke, Pflugerville, TX (US); Donald Kent Larson, Cedar Park, TX (US); Ronald Avery Nealey, Collins, OH (US)

(73) Assignee: CORNING RESEARCH & DEVELOPMENT CORPORATION, Corning, NY (US)

( * ) Notice: Subject to any disclaimer, the term of this patent is extended or adjusted under 35 U.S.C. 154(b) by 415 days.

(21) Appl. No.: 18/401,951

(22) Filed: Jan. 2, 2024

(65) Prior Publication Data

US 2024/0181592 A1 Jun. 6, 2024

Related U.S. Application Data

(63) Continuation of application No. PCT/US2022/035622, filed on Jun. 30, 2022.

(Continued)

(51) Int. Cl.
*E01C 23/09* (2006.01)
*B24B 19/00* (2006.01)

(Continued)

(52) U.S. Cl.
CPC ..... *B24B 23/02* (2013.01); *B24B 19/00* (2013.01); *B24B 27/0007* (2013.01); *E01C 23/088* (2013.01); *E01C 23/09* (2013.01)

(58) Field of Classification Search
CPC ..... E01C 23/088; E01C 23/09; B24B 19/00; B24B 23/02; B24B 27/0007

(Continued)

(56) References Cited

U.S. PATENT DOCUMENTS 5,378,081 A * 1/1995 Swisher, Jr. ..... E01C 23/088 299/39.5
5,382,084 A * 1/1995 Diver ..... E01C 23/088 299/39.5

(Continued)

FOREIGN PATENT DOCUMENTS

CA 2438488 A1 8/2002

OTHER PUBLICATIONS

European Patent Application No. 19890957.4 Communication pursuant to Article 94(3) EPC dated Feb. 20, 2024; 5 Pages; European Patent Office.

(Continued)

*Primary Examiner* — Raymond W Addie
(74) *Attorney, Agent, or Firm* — William D. Doyle

(57) ABSTRACT

Disclosed herein are grinding machines for forming a trench. Embodiments relate to a grinding machine with a grind head and a vehicle mount. The grind head includes a housing body and a grinding drum. The vehicle mount is configured to attach the housing body to a vehicle. One embodiment of the disclosure relates to a trunnion attachment configured to attach the housing body to a vehicle such that the housing body is configured to roll about a roll axis oriented in a travel direction relative to the vehicle mount. The roll axis is proximate an initial contact point of the blade set. In another embodiment, a caster attachment is configured to attach the housing body to a vehicle such that the housing body is configured to yaw about a yaw axis oriented in an upward direction relative to the vehicle mount.

20 Claims, 16 Drawing Sheets

Related U.S. Application Data

(60) Provisional application No. 63/217,841, filed on Jul. 2, 2021.

(51) Int. Cl.
*B24B 23/02* (2006.01)
*B24B 27/00* (2006.01)
*E01C 23/088* (2006.01)

(58) Field of Classification Search
USPC ..... 404/72–75, 94
See application file for complete search history.

(56) References Cited

U.S. PATENT DOCUMENTS 5,879,109 A 3/1999 Finzel et al.
5,882,086 A 3/1999 Bremner et al.
6,227,620 B1 * 5/2001 Page ..... E01C 23/088 451/236
6,318,351 B1 11/2001 Baratta
6,371,691 B1 4/2002 Finzel et al.
6,755,482 B2 * 6/2004 Johnson ..... E01C 23/0993 404/93
7,351,009 B2 4/2008 Serrano et al.
7,564,092 B2 7/2009 Ryu et al.
8,025,342 B2 * 9/2011 Kraemer ..... E01C 23/088 299/39.6
9,203,226 B2 12/2015 Miller
9,531,174 B2 12/2016 Elford et al.
10,606,018 B2 3/2020 Clatanoff et al.
2004/0005190 A1 * 1/2004 Jakits ..... E01C 23/0993 404/94
2006/0078384 A1 * 4/2006 Jacob ..... E01C 23/0885 404/94
2008/0008527 A1 * 1/2008 Kraemer ..... E01C 23/088 404/94
2009/0232598 A1 9/2009 Cochran et al.
2012/0299364 A1 11/2012 Schroeder et al.
2013/0000784 A1 1/2013 Holmes
2013/0011198 A1 1/2013 Pichler et al.
2014/0270956 A1 9/2014 Seovic
2016/0060826 A1 3/2016 Berning et al.
2016/0376767 A1 12/2016 Miller
2018/0017750 A1 1/2018 Clatanoff et al.
2019/0161923 A1 5/2019 Mahaffey, Jr. et al.

OTHER PUBLICATIONS

European Patent Application No. 22834184.8 Extended European Search Report and Search Opinion dated Jul. 16, 2025; 9 Pages; European Patent Office.
International Search Report and Written Opinion of the International Searching Authority; PCT/US2022/035622; dated Oct. 5, 2022; 7 pages; US Patent Office.

* cited by examiner

GRINDING MACHINE FORMING A TRENCH

CROSS-REFERENCE TO RELATED APPLICATION

This application is a continuation of International Patent Application No. PCT/US2022/035622 filed Jun. 30, 2022, which claims the benefit of priority under 35 U.S.C. § 119 of U.S. Provisional Application Ser. No. 63/217,841, filed on Jul. 2, 2021, the content of which is relied upon and incorporated herein by reference in its entirety.

BACKGROUND

The present disclosure relates to a grinding machine. In particular, the present disclosure relates to a grinding machine (e.g., vehicle mounted) forming a trench.

Fiber to the premises (FTTP) has increased in popularity as improvements in micro-trenching have provided greater reliability and increased efficiency. However, micro-trenching often requires removal of large amounts of material with large and expensive equipment that limits micro-trench locations (e.g., curbs) and results in substantial debris that requires frequent and costly disposal. Alternatively, other processes may be used to form a nano-trench in the pavement, position a fiber optic cable therein, and cover with road tape, which reduces the time and cost of deploying fiber networks.

Such processes are often limited in the creation of a consistent and precise nano-trench due to a limit in controlling the size and shape of the nano-trench. This may produce vulnerabilities in the fiber optic cable and/or road tape. For example, FIG. 1 is a side view of a grinding machine 100 with a grinding drum 102 positioned between a front wheel 104 and rear wheels 106. Such a configuration produces a grind of a desired depth when traveling over a flat surface 108, but produces a shallow grind when traveling over a valley 108' between the front wheel and the rear wheels and produces a deep grind when traveling over a crest 108" between the front wheel 104 and the rear wheels 106. In other words, the grinding machine 100 cannot adequately adapt to road contours to produce a consistent nano-trench depth because of the horizontal offset of the axis of the wheels 104, 106 from the axis of the grinding drum 102. Accordingly, such grinding machines cannot produce consistent and precise nano-trenches over a wide variety of road contours or other terrain.

SUMMARY

One embodiment of the disclosure relates to a grinding machine, including a grind head and a vehicle mount. The grind head includes a housing body and a grinding drum comprising an axle and a blade set mounted thereto. The axle is rotatably coupled to the housing body. The vehicle mount is attached to the housing body. The vehicle mount includes a trunnion attachment configured to attach the housing body to a vehicle such that the housing body is configured to roll about a roll axis oriented in a travel direction relative to the vehicle mount. The roll axis is proximate an initial contact point of the blade set.

An additional embodiment of the disclosure relates to a grinding machine, including a grind head and a vehicle mount. The grind head includes a housing body and a grinding drum comprising an axle and a blade set mounted thereto. The axle is rotatably coupled to the housing body. The vehicle mount is attached to the housing body. The vehicle mount includes a caster attachment configured to attach the housing body to a vehicle such that the housing body is configured to yaw about a yaw axis oriented in an upward direction relative to the vehicle mount.

Additional features and advantages will be set out in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary and are intended to provide an overview or framework to understanding the nature and character of the claims. The accompanying drawings are included to provide a further understanding and are incorporated in and constitute a part of this specification. The drawings illustrate one or more embodiment(s), and together with the description, serve to explain principles and operation of the various embodiments.

DETAILED DESCRIPTION

Figure 1:
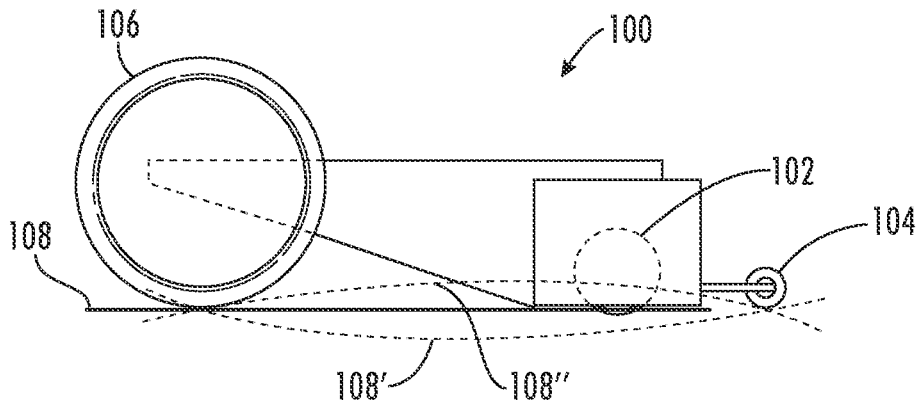
FIG. 1 is a side view of a grinding machine with a grinding drum positioned between a front wheel and rear wheels.

Reference will now be made in detail to the presently preferred embodiments, examples of which are illustrated in the accompanying drawings. Whenever possible, the same reference numerals will be used throughout the drawings to refer to the same or like parts.

The embodiments set out below represent the information to enable those skilled in the art to practice the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The use herein of ordinals in conjunction with an element is solely for distinguishing what might otherwise be similar or identical labels, such as "first layer" and "second layer," and does not imply a priority, a type, an importance, or other attribute, unless otherwise stated herein.

The term "about" used herein in conjunction with a numeric value means any value that is within a range of ten percent greater than or ten percent less than the numeric value.

As used herein, the articles "a" and "an" in reference to an element refers to "one or more" of the element unless otherwise explicitly specified. The word "or" as used herein is inclusive unless contextually impossible. As an example, the recitation of A or B means A, or B, or both A and B.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

The use herein of "proximate" means at, next to, or near.

The terms "left," "right," "top," "bottom," "front," "back," "horizontal," "parallel," "perpendicular," "vertical," "lateral," "coplanar," and similar terms are used for convenience of describing the attached figures and are not intended to limit this disclosure. For example, the terms "left side" and "right side" are used with specific reference to the drawings as illustrated, and the embodiments may be in other orientations in use. Further, as used herein, the terms "horizontal," "parallel," "perpendicular," "vertical," "lateral," etc., including slight variations that may be present in working examples.

Figure 2A:
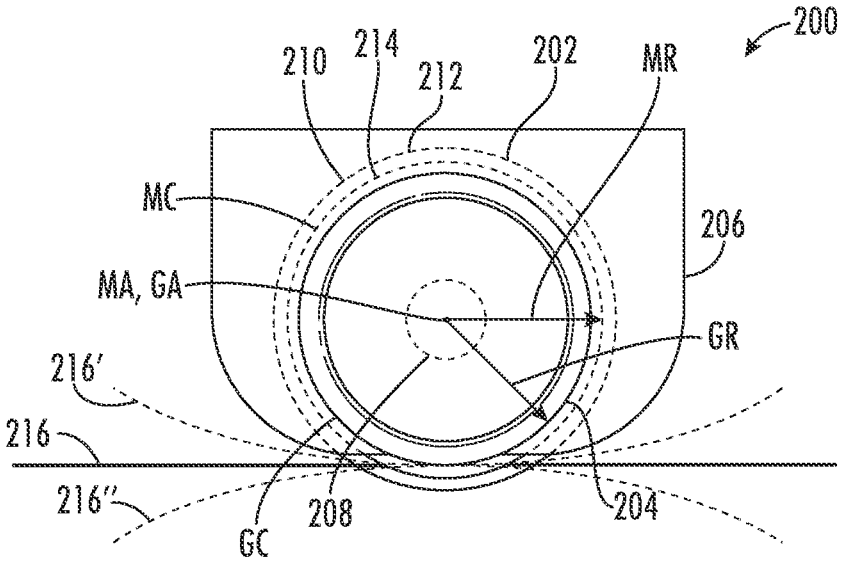
FIG. 2A is a side view of a grinding apparatus with a grinding drum positioned between and horizontally aligned with two guides.
Figure 2B:
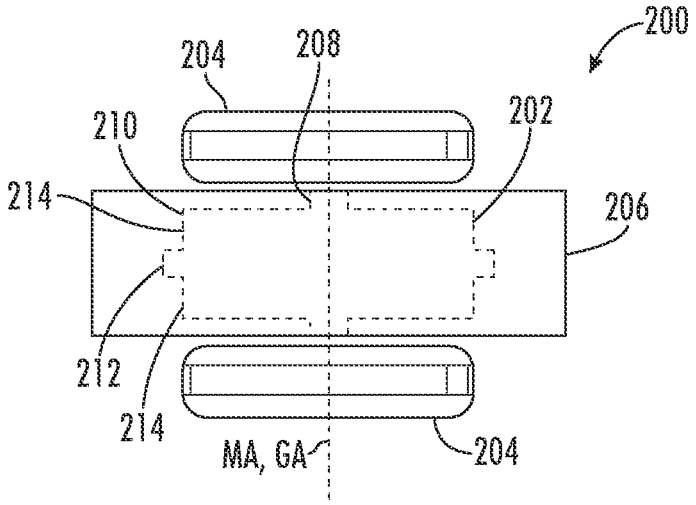
FIG. 2B is a top view of the grinding apparatus of FIG. 2A.

FIGS. 2A-2B are views of a grinding apparatus 200 with a grinding drum 202 positioned between and horizontally aligned with a pair of guides 204. In certain embodiments, the grinding apparatus 200 is a grinding machine or grinding tool including a housing 206 (e.g., grinding housing or housing body, etc.), the grinding drum 202, and the pair of guides 204. In certain embodiments, the grinding apparatus 200 includes a handle attached to the housing, such as used in a walk-behind handheld grinding tool. In certain embodiments, the grinding apparatus 200 includes a vehicle mount attached to the housing to attach the housing to a vehicle, such as in a vehicle mounted grinding machine pushed or pulled by a vehicle (e.g., motorized vehicle, truck, etc.).

The grinding drum 202 includes an axle 208 and a blade set 210 mounted thereto. The blade set 210 includes at least one channel blade 212 and a plurality of milling blades 214 on opposing sides of the at least one channel blade 212. The axle 208 is rotatably coupled to the housing 206. Rotation of the plurality of milling blades 214 defines a mill curvature MC and a mill radius MR about a mill axis MA.

The pair of guides 204 (e.g., pair of wheels, skis, etc.) are on opposing sides of the blade set 210. The pair of guides 204 is configured to limit a grinding depth of the grinding drum 202. Each of the pair of guides 204 defines a guiding curvature GC and a guide radius GR about a guide axis GA. At least a portion of the guide curvature GC being generally concentric with the mill curvature MC. The guide radius GR is less than the mill radius MR. Each of the pair of wheels is horizontally aligned with the grinding drum 202. The mill axis MA of the grinding drum 202 is aligned (e.g., horizontally and/or axially) with the guide axis GA of the pair of guides 204, such as within 10 mm. At least a portion of the guide curvature GC is generally concentric with the mill curvature MC. The guide radius GR is less than the mill radius MR.

Positioning of the pair of guides 204 along the MA of the grinding drum 202 maintains a consistent depth regardless of pavement contour. In particular, such a configuration maintains a grind of a desired depth when traveling over a flat surface 216, a valley 216', and/or a crest 216". The grinding apparatus 200 adapts to road contours to produce a consistent nano-trench depth because of the horizontal alignment of the guide axis GA of the pair of guides 204 from the mill axis MA of the grinding drum 202. The pair of guides 204 and the grinding drum 202 are on the same centerline and/or in the same plane. The grinding apparatus 200 (without relying on front and back wheels for support during grinding) provides a consistent and precise nano-trench (e.g., consistent depth) over a wide variety of road contours or other terrains regardless of surface irregularities or variations (e.g., uneven surfaces, undulating surfaces, crests, valleys, road contours, curb contours, etc.).

Figure 3A:
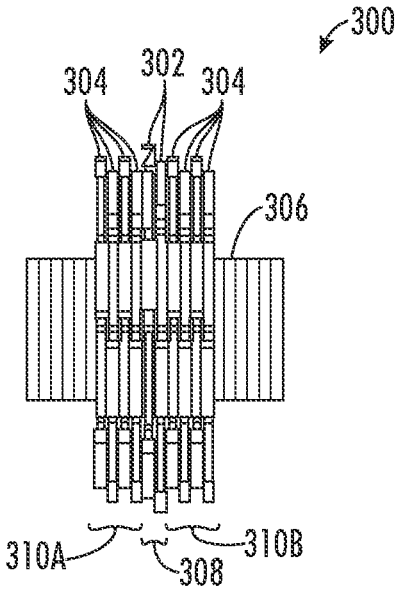
FIG. 3A is a front view of one embodiment of the grinding drum of FIGS. 2A-2B.
Figure 3B:
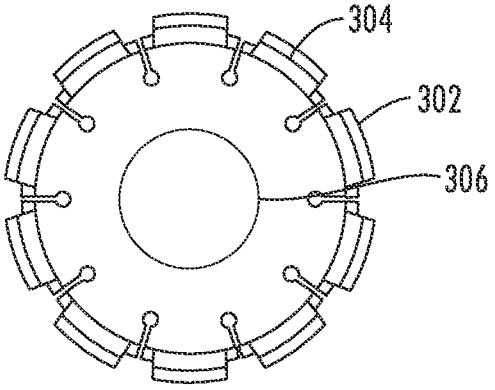
FIG. 3B is a side view of the grinding drum of FIG. 3A.

FIGS. 3A-3B are views of one embodiment of the grinding drum 202 of FIGS. 2A-2B. Grinding drum 300 provides for simultaneously milling both a channel and a recessed area on either side of the channel in a single pass. At least one channel blade 302 and a plurality of milling blades 304 are mounted on a blade axle 306. In certain embodiments, the at least one channel blade 302 and/or the plurality of milling blades 304 are diamond-tipped, which provides for longer wear and fasting cutting. The at least one channel blade 302 is centered on the blade axle 306, and at least one milling blade 304 of the plurality of milling blades 304 is mounted on each side of the at least one channel blade 302. The at least one channel blade 302 and/or plurality of milling blades 304 fit securely on the blade axle 306. The at least one channel blade 302 has a larger radius than the plurality of milling blades 304 to provide a predetermined depth of the channel relative to the recess.

In certain embodiments, the at least one channel blade 302 includes a set 308 of channel blades 302 centrally mounted on the blade axle 306, the plurality of milling blades 304 includes a first set 310A of four milling blades 304 mounted directly on one side of the set 308 of the channel blades 302, and a second set 310B of four milling blades are mounted on the other side of the set 308 of channel blades 302. Of course, more or fewer channel blades 302 and/or milling blades 304 may be used depending on the application.

In certain embodiments, the set 308 of channel blades 302 includes only one channel blade 302 (e.g., 0.25 inches wide). Grind smoothness is determined by spacing between the cutting blades (e.g., the channel blades 302 and/or the milling blades 304). In certain embodiments, washers are used to space the channel blades 302 and/or the milling blades 304, where thicker washers provide a more corrugated grind finish, and thinner washers provide a smoother grind finish. In certain embodiments, spacer washers are provided on either side of the channel blades 302 (i.e., between the channel blades 302 and the milling blades 304).

Figure 3C:
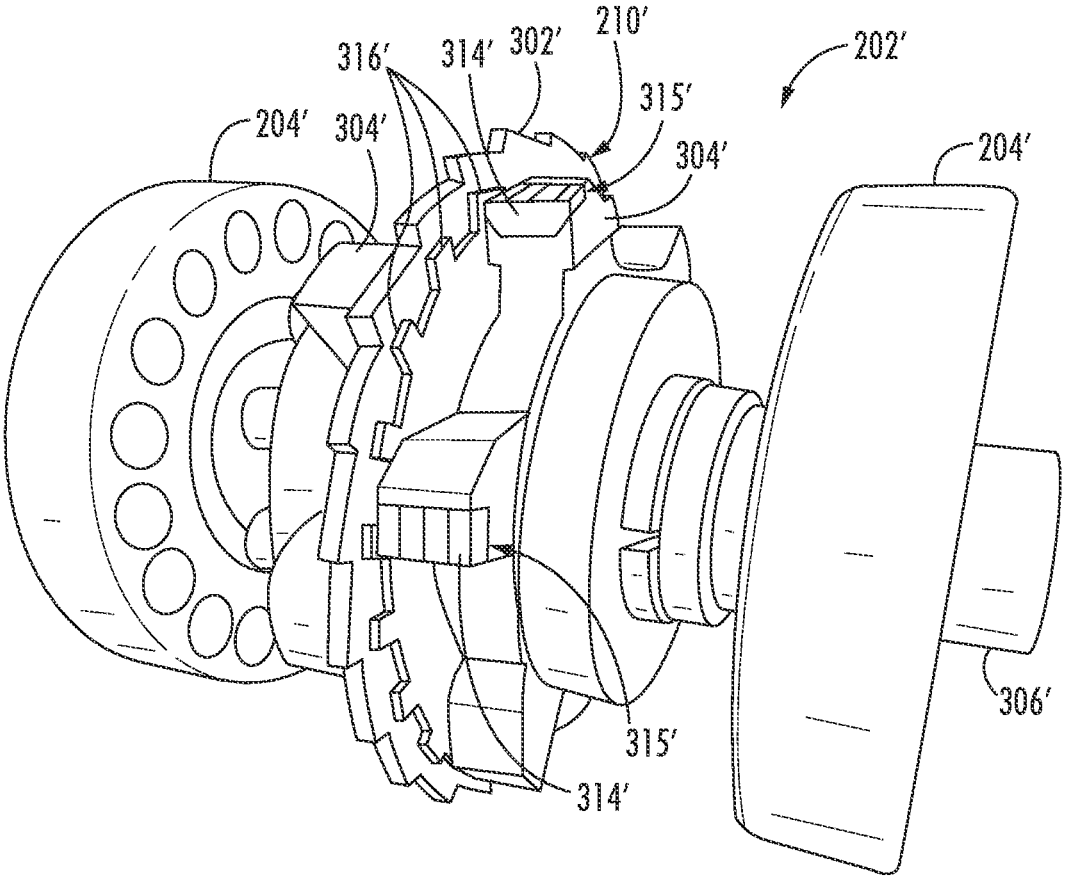
FIG. 3C is a side view of another embodiment of the grinding drum of FIGS. 2A-2B.

FIG. 3C is a side view of another embodiment of the grinding drum 202 of FIGS. 2A-2B. As similarly described above, the grinding drum 202' includes at least one channel blade 302' and a plurality of milling blades 304' mounted on a blade axle 306'. In certain embodiments, the grinding drum 202' includes a pair of guides 204' mounted on opposing sides of blade set 210'. The pair of guides 204' is embodied as ball bearings 204' mounted to the blade axle 306'. The ball bearings 204' are configured to limit a grinding depth of the blade set 210' The center of a rotation axis of the ball bearings 204' is aligned with the center of a rotation axis of the blade axle 306' and blade set 210'. In other words, the mill axis MA of the blade set 210' is aligned (e.g., horizontally and/or axially) with the guide axis GA of the ball bearings 204', such as within 10 mm. When the ball bearings 204' contact the road, an outer ring (e.g., steel) of the ball bearings 204' remain stationary, while an inner ring (e.g., steel) of the ball bearings 204' rotates with the blade axle 306' and the blade set 210'.

In certain embodiments, the at least one channel blade 302' and/or the plurality of milling blades 304' are tipped with polycrystalline diamond (PCD). For example, the teeth of the channel blade 302 include a PCD tip 312' and the teeth of the milling blades 304' include a PCD tip 314'. PCD provides an improvement in durability compared to diamond-tipped blades, which wear along the edges, and may result in a rounded edge. Comparatively, PCD blades have been found to exhibit wear rates about 10% of that of diamond-tipped blades. Further, with PCD blades 302', 304', the grinding apparatus can grind at higher rotation speeds and/or higher translation speeds. In other words, with PCD blades 302', 304', the grinding apparatus can grind more accurate depths at faster grinding speeds. For example, in certain embodiments, the PCD blades 302', 304' grind at 60 ft/min with a resulting cut depth+/−0.005 inches. This provides 90% reduction in grind depth variation compared to diamond-tipped blades. In certain embodiments, the PCD blades 302', 304' grind at 200 ft/min, which is over ten times the grinding speed used with diamond-tipped blades. In certain embodiments, the PCD tips 314' are scalloped across a width of the milling blade 304. For example, the scallop may be in the shape of a sine wave. Further, the milling blade 304' includes a plurality of recesses 315' for mounting the PCD tip 314'.

In certain embodiments, the channel blade 302' includes a chamfer teeth 316' at a side of the channel blade 302'. In particular, the chamfer teeth 316' are positioned at a radius more than that of the PCD tip 314' of the milling blades 304' and less than the PCD tip 312' of the channel blade 302'.

Figure 4A:
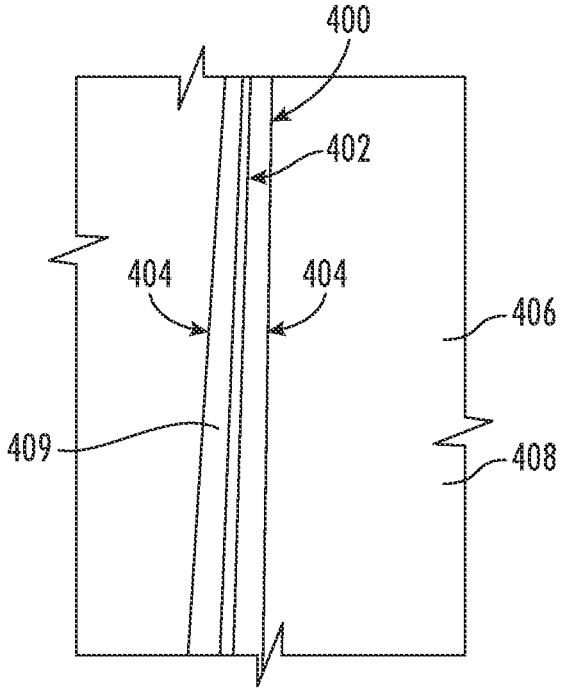
FIG. 4A is a perspective view of a nano-trench, including a channel and a recess milled by the grinding drum of FIGS. 3A-3C.

FIG. 4A is a perspective view of a nano-trench 400 including a channel 402 and recesses 404 (may also be referred to as a recessed area, milled recess, etc.) milled by the grinding drum 300, 300' of FIGS. 3A-3C. Use of the grinding drum 300, 300' provides for a single-pass process that symmetrically produces the channel 402 and the recesses 404 on either side of the channel 402 within a substrate 406. The channel 402 and the recesses 404 of the nano-trench 400 form a T-slot feature, although other shaped nano-trenches may be formed. The substrate 406 is milled to include a recess 404 that is wider than the channel 402, below an upper surface 408 of the substrate 406 the channel 402. The substrate 406 may be any type or of any material (e.g., asphalt, concrete, pavement, road, curb, walkway, bridge support, building base, etc.). Accordingly, the grinding drum 300, 300' (e.g., the PCD tips 312', 314') are used to create accurate depth and/or width of the channel 402 and/or recesses 404 of the nano-trench 400.

Figure 4B:
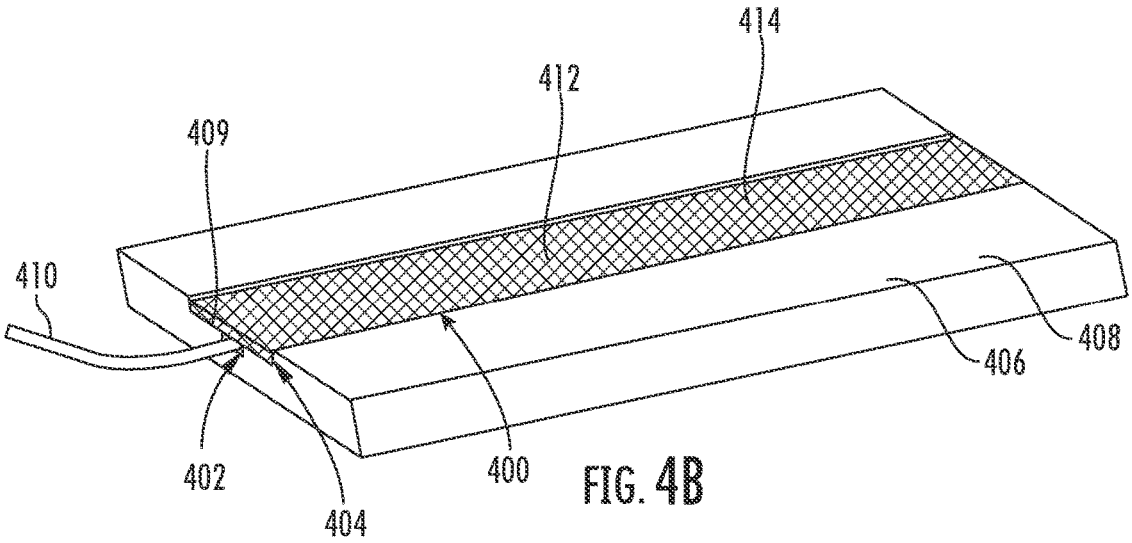
FIG. 4B is a perspective view of a distribution cable within the channel and cabling tape in the recess of the nano-trench of FIG. 4A.
Figure 4C:
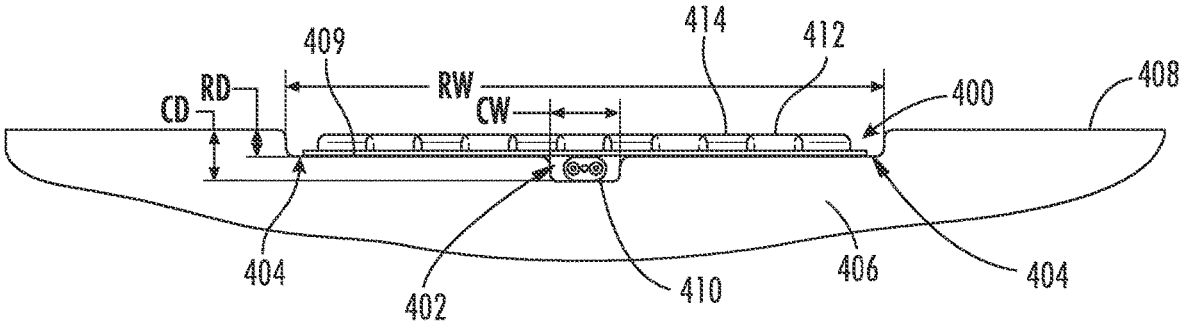
FIG. 4C is a cross-sectional side view of the cabling tape, distribution cable, and nano-trench of FIG. 4B.
Figure 5A:
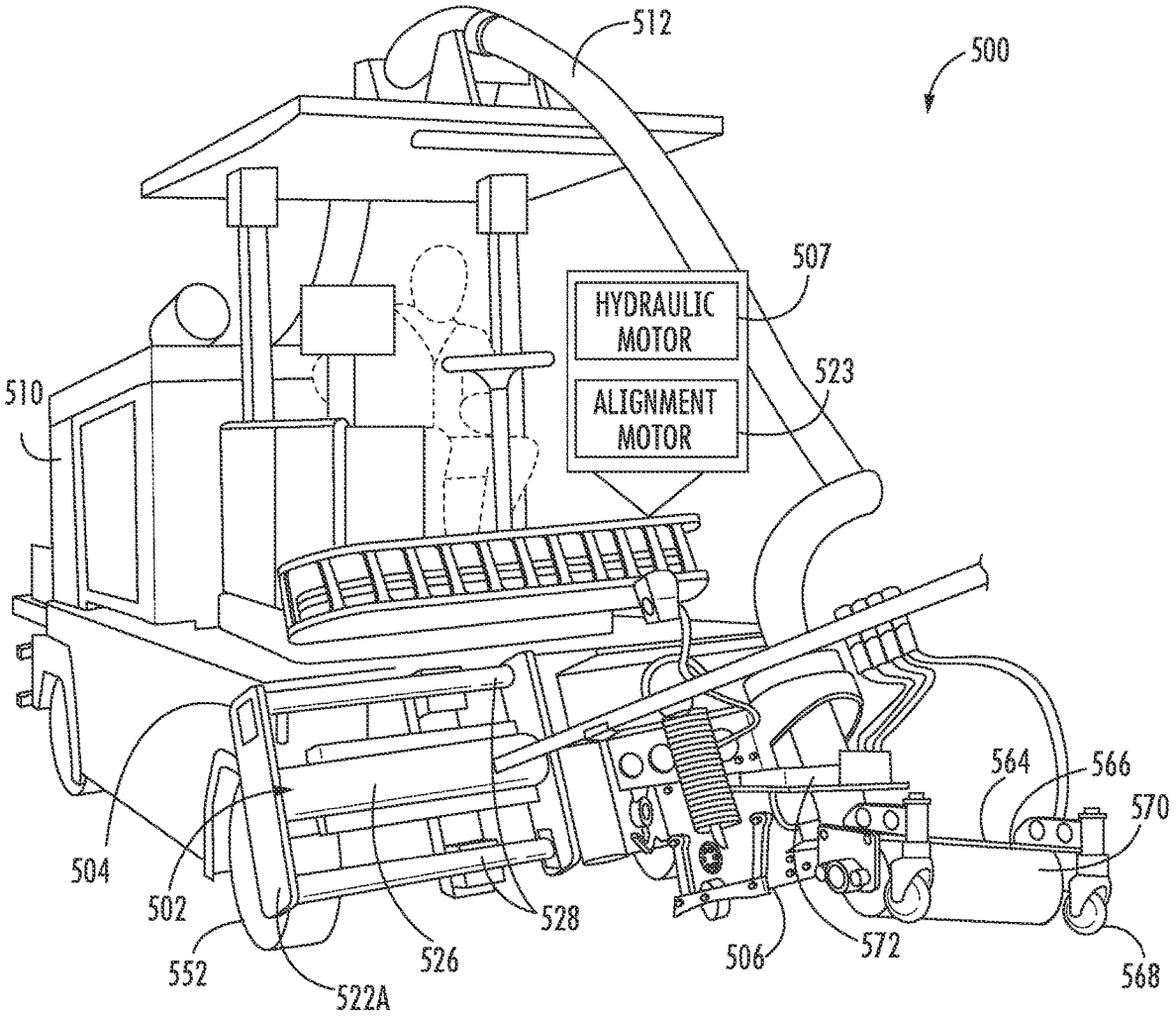
FIG. 5A is a perspective view of a vehicle with a grinding machine mounted to the vehicle.
Figure 5B:
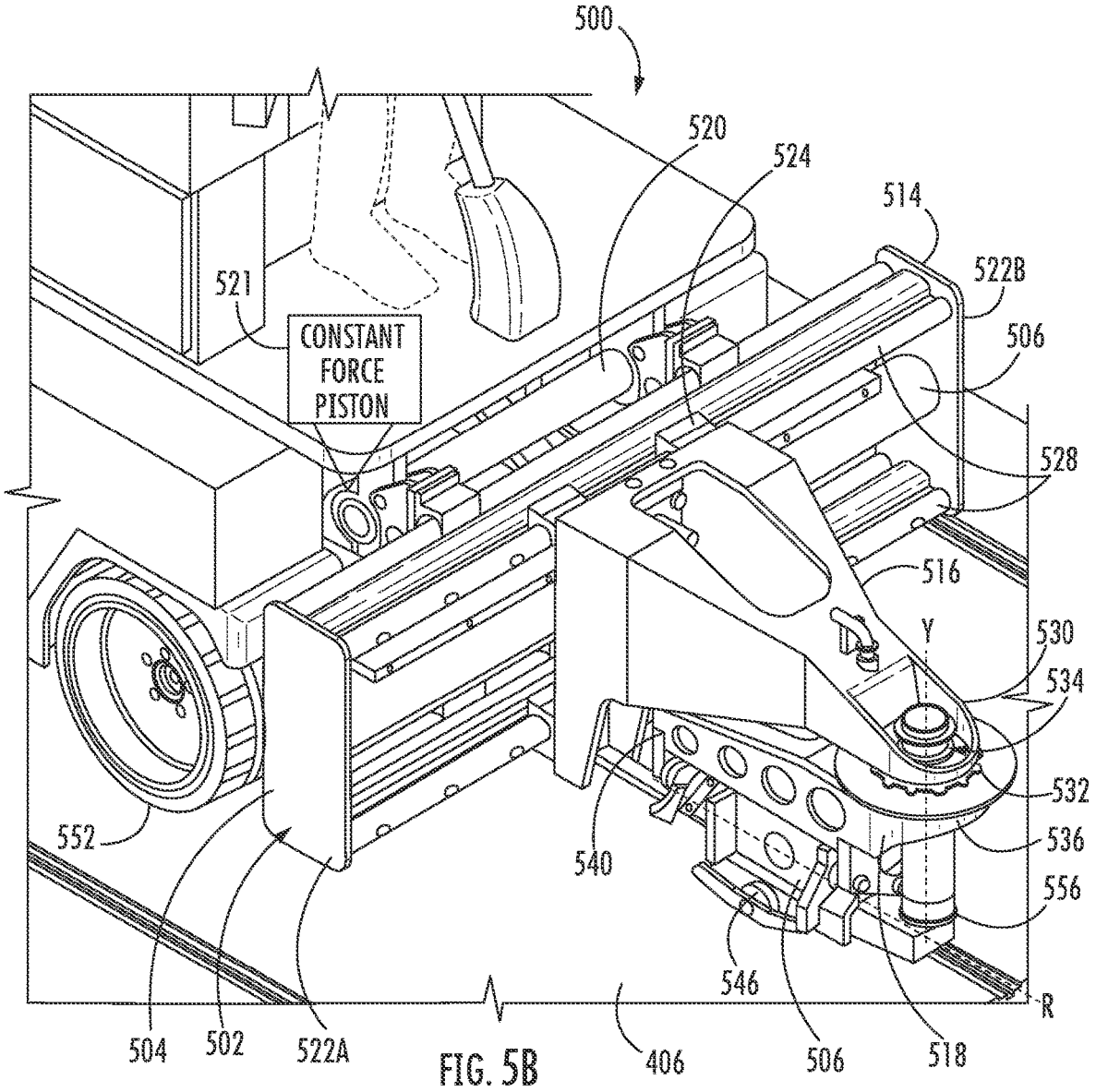
FIG. 5B is a perspective view of the grinding machine and a portion of the vehicle of FIG. 5A.
Figure 5C:
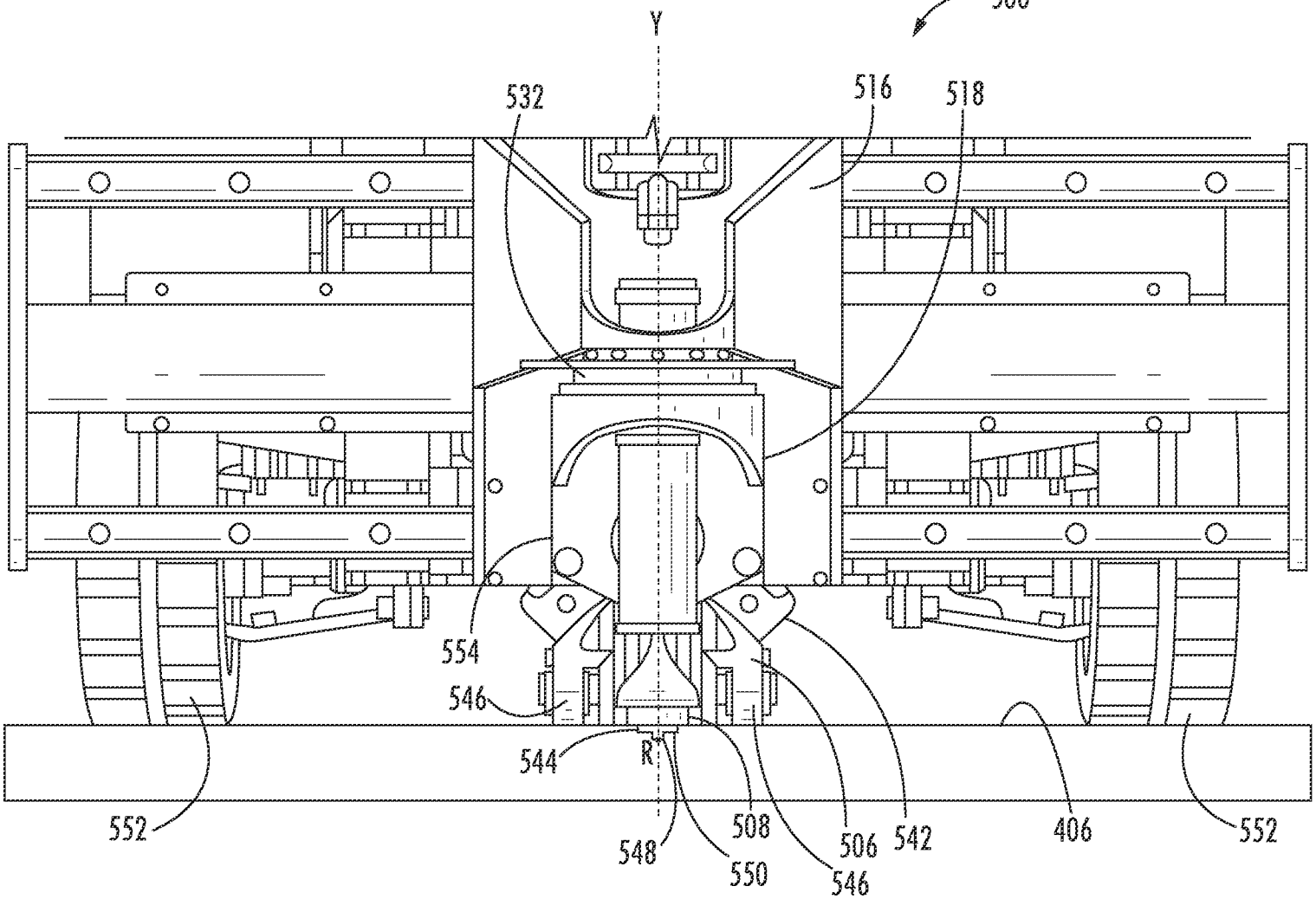
FIG. 5C is a front view of the grinding machine and a portion of the vehicle of FIG. 5A.
Figure 5D:
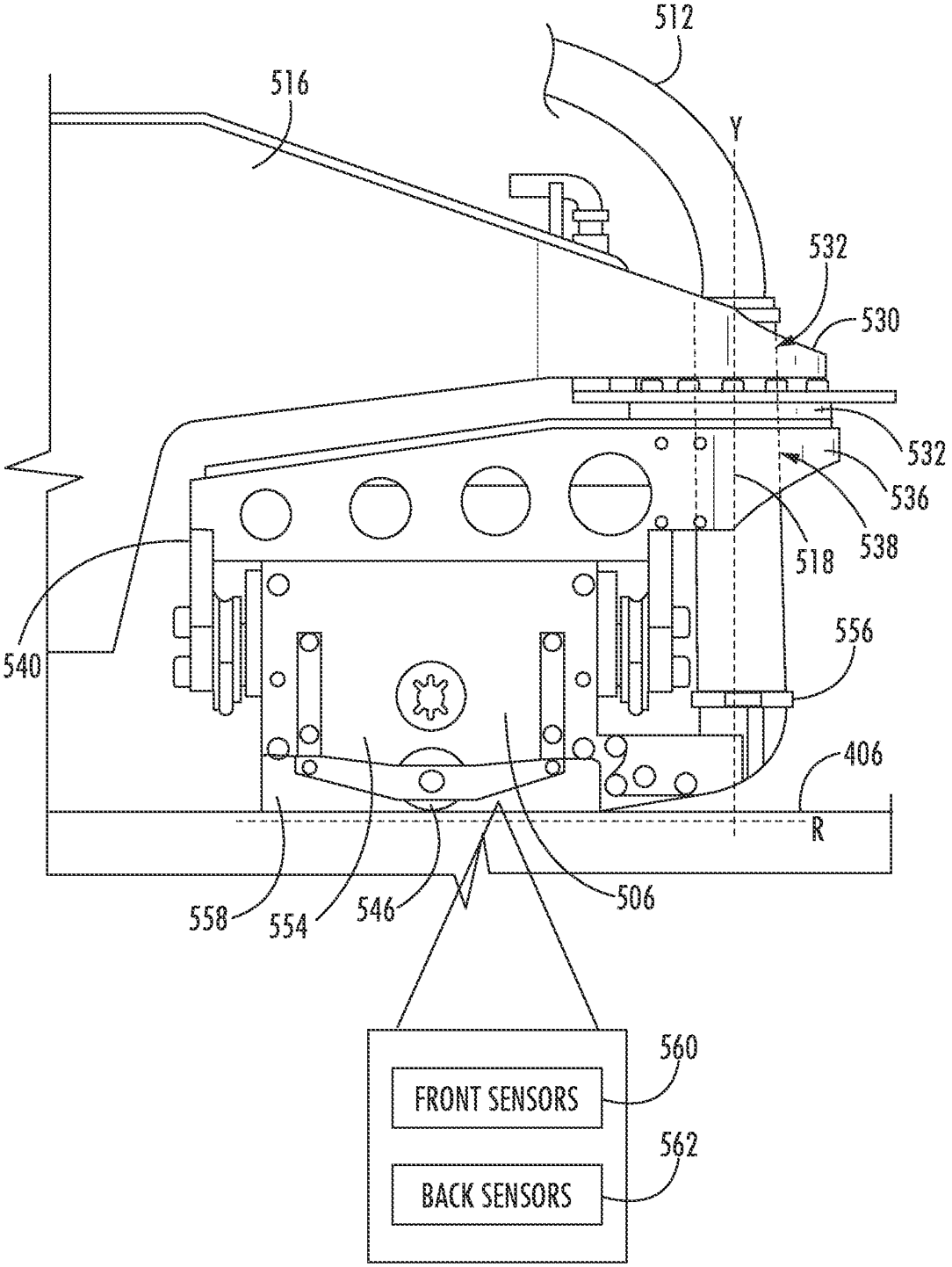
FIG. 5D is a side view of a portion of the grinding machine of FIG. 5A.

FIGS. 4B-4C are views of a distribution cable 410 within the channel 402 and a cabling tape 412 in the recess 404 of the nano-trench 400 of FIG. 4A. Once the nano-trench 400 is formed, the distribution cable 410 is placed within the channel 402, the cabling tape 412 is placed in the recess 404 over the channel 402 and the distribution cable 410. Such work can be performed even if the substrate 406 is wet, as grinding exposes a new, dry surface for adherence of the cabling tape 412. The channel 402 protects the distribution cable 410, such as from road surface impact. The cabling tape 412 is durable and covers and protects the distribution cable 410. In certain embodiments, the channel 402 may be adhesive-free or may include some amount of adhesive to hold the distribution cable 410 in place during deployment and/or to provide a water sealant and/or water blocking material.

The cabling tape 412 covers the distribution cable 410 and is adhered to the substrate 406 within the recess 404 such that an exposed upper surface 414 of the cabling tape 412 may sit substantially flush with or slightly below the upper surface 408 of the substrate 406. The cabling tape 412 is configured to adhere to the substrate 406. The cabling tape 412 may include an adhesive layer that is capable of adhering to the substrate 406. In certain embodiments, an adhesive compound may be applied to the substrate 406 separately from the cabling tape 412, such that the cabling tape 412 is pressed into the adhesive for bonding to the substrate 406.

The distribution cable 410 fits entirely within the channel 402, and the upper surface 414 of the cabling tape 412 is flush with or slightly below the upper surface 408 of the substrate 406. In certain embodiments, the depth of the recess 404 impacts contact with vehicle tires, which affects durability and lifetime of the cabling tape 412.

A channel width CW of the channel 402 and a recess width RW of the recess 404 are determined by grinding drum 200, 300, 300' (see FIGS. 2A-3C). Referring to FIGS. 3A and 4A-4C, the number of channel blades 302 used to form the channel 402 depends on the dimensions and/or orientation of the distribution cable 410. The number of milling blades 304 used to form the recess 404 depends on the width of the cabling tape 412. In other words, the width of the channel 402 can be adjusted by the number and/or width of the channel blades 302, and the width of the recess 404 can be adjusted by the number and/or width of the milling blades 304.

The profiles of the channel 402 and the recess 404 are slightly wider than the profiles of both the distribution cable 410 and cabling tape 412, respectively. For example, in certain embodiments, the cabling tape 412 has a width of 0.5-4 inches, and the recess width RW of the recess 404 is at least 0.25 inches larger (e.g., between 1-6 inches). In certain embodiments, the channel width CW of the channel 402 may be 0.25-2 inches wide (e.g., to accommodate different sized fiber optic cables and/or orientations). The channel 402 and/or the recess 404 can be any size and/or shape to accommodate additional cable(s), and similarly, the recess width RW could be wider or narrower to accommodate any size and/or shape of the cabling tape 412.

The depth profile of the channel 402 and the recess 404 may be adjusted during milling, such as to maximize the protection of both the distribution cable 410 and cabling tape 412. In certain embodiments, a channel depth CD of the channel 402 from the lower surface 409 of the recess 404 to the upper surface 408 of the substrate 406 may be generally between 0.3 inches and 1 inch, and preferably about 0.35, 0.375, or 0.55 inches. A recess depth RD of the recess 404 from the lower surface 409 of the recess 404 to the upper surface 408 of the substrate 406 may be generally 0.1 inches to 0.5 inches, and preferably between 0.15 inches and 0.2 inches.

FIGS. 5A-5D are views of a vehicle 500 with a grinding machine 502 mounted to a front of the vehicle 500. The grinding machine 502 includes a vehicle mount 504 and a grind head 506 (may also be referred to as a grinder, etc.) attached to the vehicle mount 504. In certain embodiments, the grinding machine 502 includes a hydraulic motor 507 to rotate a grinding drum 508 to grind a substrate 406. The vehicle 500 further includes a vacuum 510 with a vacuuming tube 512 in fluidic communication with the grind head 506 of the grinding machine 502. In particular, the grind head 506 of the grinding machine 502 is in fluidic communication with the vacuum 510 via the vacuuming tube 512 to suction dust and debris created by the grinding machine 502. The vehicle mount 504 can be modified for mounting to many different types of vehicles and is configured to grind long distances per day. In certain embodiments, the grinding machine 502 (e.g., hydraulic motor) and/or the vacuum 510 are powered by the vehicle 500 and/or batteries.

The vehicle mount 504 is attached to the vehicle 500 and mounts the grind head 506 to the vehicle 500. The vehicle mount 504 includes an upper mount 514, an intermediate mount 516, and a lower mount 518. The intermediate mount 516 is positioned between and coupled to the upper mount 514 and the lower mount 518. The upper mount 514 is configured to move relative to the vehicle 500, and the intermediate mount 516 is configured to move relative to the upper mount 514 and the lower mount 518.

The upper mount 514 is attached to a front of the vehicle 500. In certain embodiments, the upper mount 514 is attached by a hinge 520 (e.g., hydraulic hinge) at a top of the upper mount 514. The upper mount 514 rotates about the hinge 520 (e.g., by a hydraulic motor) to lift the grind head 506 from the substrate 406 to disengage the grind head 506 from the substrate 406. Further, the upper mount 514 rotates about the hinge 520 to lower the grind head 506 to engage the substrate 406. From a position level with the vehicle 500, the upper mount 514 can rotate upward or downward (e.g., upward 12 degrees and downward 12 degrees), such as by the hydraulic motor 507.

In certain embodiments, the vehicle 500 includes a constant force piston 521 (may also be referred to as a constant force cylinder) connected to the upper mount 514. The constant force piston 521 is configured to impart a constant downward force on the vehicle mount 504. In particular, the constant force piston 521 is configured to impart a constant extension force on the upper mount 514 independent of the orientation or distance between the vehicle 500 and the grind head 506. In this way, the upper mount 514 provides consistent downward pressure on the grind head 506 and/or is adapts to changes in elevation. For example, when the vehicle 500 moves downhill, the grind head 506 is moved downward relative to the vehicle 500 because the grind head 506 is at a front of the vehicle 500 and experiences a change in elevation before the rest of the vehicle 500.

The upper mount 514 extends across a width of the vehicle 500. The intermediate mount 56 attaches to the upper mount 514 and is configured to horizontally (laterally) translate across the width of the vehicle 500 and between sides 522A, 522B of the upper mount 514, such as by an alignment motor 523. In particular, a proximate end 524 of the intermediate mount 508 is slidably attached to the upper mount 514 to translate relative to the upper mount 514. Because the intermediate mount 508 is able to translate across a width of the vehicle 500, the grind head 506 can be positioned closer to a curb relative to the rest of the vehicle 500 and/or to follow a preconfigured grind path. In certain embodiments, the intermediate mount 516 includes a worm gear to drive the intermediate mount 516 relative to the upper mount 514. In certain embodiments, the intermediate mount 516 includes a horizontal rod 528 to support the intermediate mount 516 and allow translation thereof. The worm gear 526 and/or a horizontal rod 528 extend across the sides 522A, 522B of the upper mount 514 to drive and/or support lateral movement of the intermediate mount 516 relative to the upper mount 514.

A distal end 530 of the intermediate mount 516 includes a caster mount 532 attached to the lower mount 518. The distal end 530 of the intermediate mount 516 includes a hole 534 for receiving at least a portion of the vacuum tube 512 therein. A distal end 536 of the lower mount 518 is attached by the caster mount 532 to the distal end 530 of the intermediate mount 516. The distal end 536 of the lower mount 518 includes a hole 538 for receiving at least a portion of the vacuum tube 512 therein. In this way, the hole 534 of the intermediate mount 516 is aligned with the hole 538 of the lower mount 518. The caster mount 532 allows the grind head 506 to pivot passively as the vehicle 500 turns, avoiding sideway grinding, which may expand the width of the nano-trench 400.

The lower mount 518 is configured to rotate relative to the intermediate mount 516 about a yaw axis Y. In particular, as the vehicle 500 drives, the grind head 506 freely rotates relative to the intermediate mount 516, dependent on the movement of the vehicle 500. In this way, the proximal end 540 of the lower mount 518 trails the distal end 536 of the lower mount 518. In other words, as the vehicle 500 drives forward, the proximal end 540 of the lower mount 518 is positioned proximate to the proximal end 524 of the intermediate mount 516, with the lower mount 518 underneath the intermediate mount 516.

The grind head 506 is attached to the lower mount 518 by a trunnion 542. This allows the grind head 506 to pivot about a pivot axis P positioned perpendicular to the yaw axis Y and generally oriented in a direction of travel. The grind head 506 pivots relative to the lower mount 518 about a pivot axis P, such that the grind head 506 is rotatably attached to the lower mount 518 and is freely rotatable relative to the lower mount 518. The grind head 506 includes a grinding drum 508 with a blade set 544 and a pair of guides 546. The blade set 544 includes a channel blade 548 and milling blades 550 on opposing sides thereof. The pivot axis P extends proximate (e.g., through) a lower surface of the channel blade 548 of the grinding drum 508. The trunnion 542 allows for the grind head 506 to remain in constant contact with the substrate 406 and to adapt to any lateral undulations of the substrate 406 between wheels 552 of the vehicle 500.

In certain embodiments, the grind head 506 includes the housing body 554, a vacuum port 556 at a front of the housing body 554. The grinding drum 508 is at least partially positioned within the housing body 554. The grinding drum 508 is mounted to and extends between sides of the housing body 554. The vehicle mount 504 is mounted to the housing body 554 of the grind head 506. In particular, the lower mount 518 is attached to the housing body 554.

In certain embodiments, the hydraulic motor 523 rotates the grinding drum 508 to grind the substrate 406. The grinding drum 508 rotates with the bottom of the blades 548, 550 moving forward. In other words, the grinding drum 508 grinds against the direction of travel. This facilitates grinding of the substrate 406 so that the grinding drum 508 cuts into the substrate 406 instead of pulling the grinding drum 508 over the substrate 406. Such a configuration propels dust and debris forward within the housing body 554. Accordingly, the vacuum port 556 is positioned at the front of the housing body 554 to better suction the debris and dust from within the housing body 554.

In certain embodiments, the grind head 506 further includes a vacuum skirt 558 extending from the bottom of the housing body 554 and at least partially enclosing a bottom of the grinding drum 508. In particular, the vacuum skirt 558 extends along the sides and the front of the housing body 554, but not at the back of the housing body 554. Further, the vacuum skirt 558 is compressible to better form a seal between the housing body 554 and the substrate 406. The vacuum skirt 558 forms a seal to facilitate suction of debris from between the grinding drum 508 and the front of the housing body 554 while promoting airflow through the back of the housing body 554.

Each of the pair of guides 546 (e.g., ball bearings) is configured to pivot the grind head 506 and/or limit a grinding depth of the grinding drum 508. The narrow contact points of the pair of guides 546 react to local changes in road contours better than wide stance machines. As the road contour changes horizontally, the pair of guides 546 pivots the grind head 506 about the pivot axis P, along an arc defined by the trunnion 542 to maintain a grinding depth and shape of the grinding drum 542. In this way, the housing body 534 is configured to roll about a travel direction relative to the vehicle mount 504 to follow crossroad contour changes. The pair of guides 546 are on opposing sides of the blade set 544, with each of the pair of guides 546 axially aligned with the blade set 544 of the grinding drum 508. Thus, the pair of guides 546 limit the grinding depth of the grinding drum 508.

In certain embodiments, the grind head 506 includes the front sensors 560 attached to the front of the grind head 506 to determine lateral deviation of the grinding drum 508 from a predetermined grinding path. In other words, the front sensors 560 are positioned frontward of the grinding drum 508 to determine lateral deviation from a predetermined grind path. The grinding machine 502 then operates the alignment motor 523 to laterally move the grind head 506 to correct for any such lateral deviation. The grind head 506 also includes back sensors 562 attached to a back of the grind head 506 to measure a grinding depth of the grinding drum 508.

In certain embodiments, the grinding machine 502 includes a brush assembly 564 pivotally attached to the lower mount 518. The brush assembly 564 includes a body 566 and front wheels 568 attached to the body 566. The brush assembly 564 includes a brush roller 570 attached to the body 566 and positioned behind the wheels 568. Further, the brush assembly 564 includes side supports 572 pivotally attached to the lower mount 518, allowing the brush assembly 564 to pivot upward and downward relative to the grind head 506. The brush assembly 564 is positioned forward of the grind head 506. The brush roller 570 rotates relative to the body 566 to clear debris (e.g., rocks, pebbles, etc.). The brush roller 570 is wider than a width of the pair of guides 546 to clear debris and prevent the pair of guides 546 from hitting the debris and altering performance of the grind head 506. This provides a more accurate and consistent nano-trench 400.

Figure 6:
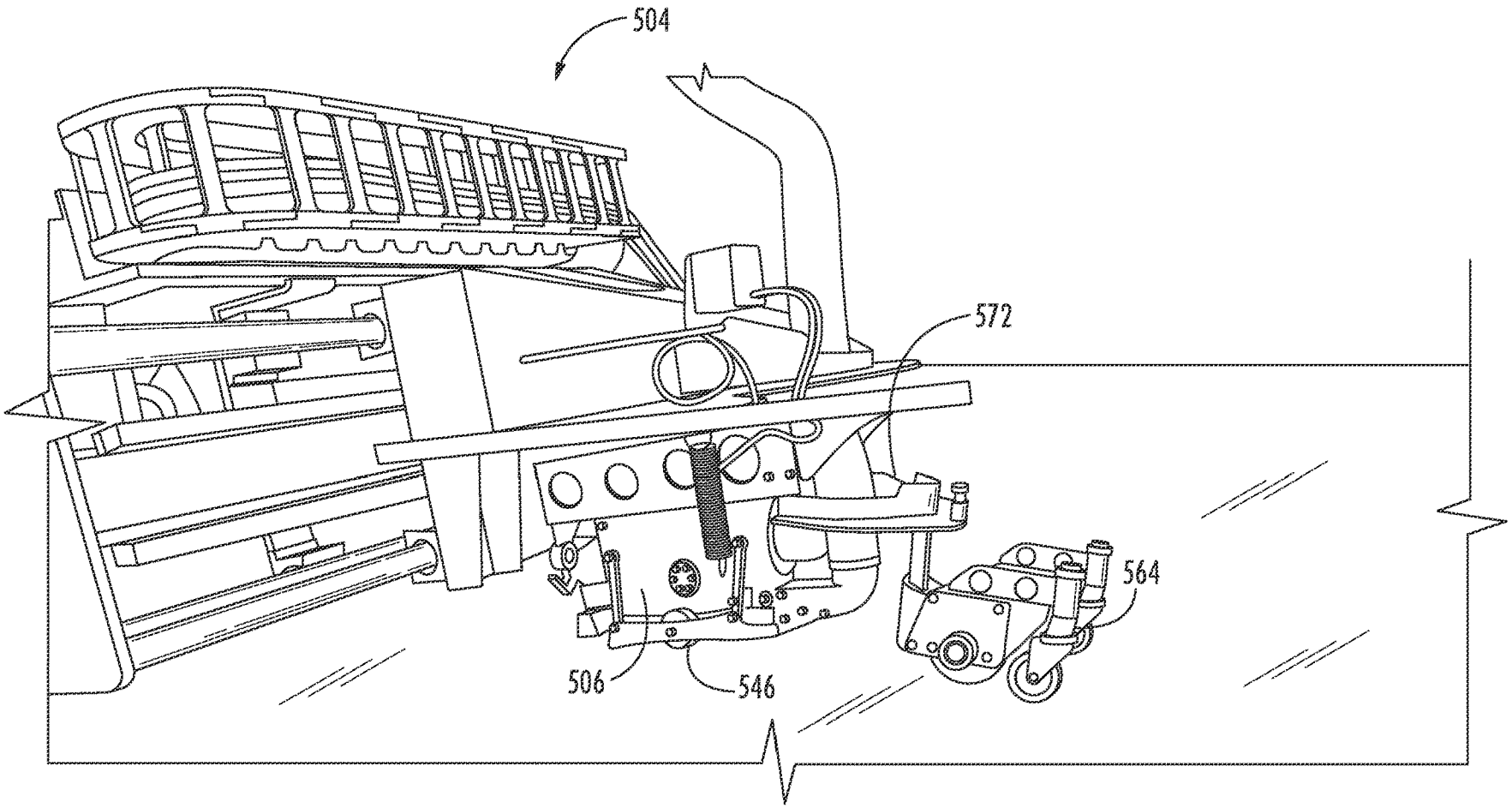
FIG. 6 is a perspective view illustrating rotation of an upper mount of the grinding machine of FIGS. 5A-5D to disengage the grinding machine from grinding.

FIG. 6 is a perspective view illustrating rotation of an upper mount 514 of the grinding machine 502 of FIGS. 5A-5D to disengage the grinding machine 502 from grinding. As noted above, the upper mount 514 rotates about the hinge 520 (see FIGS. 5A-5D) to lift the grind head 506 from the substrate 406 to disengage the grind head 506 from the substrate 406, or to lower the grind head 506 to engage the substrate 406. From a position level with the vehicle 500, the upper mount 514 can rotate upward or downward (e.g., upward 12 degrees and downward 12 degrees). Further, a constant force piston 521 (see FIGS. 5A-5D) may be used to impart a constant downward force on the vehicle mount 504 and the resulting grind head 506.

The brush assembly 564 pivotally attached by side supports 572 to the lower mount 518 and hangs from the lower mount 518 by gravity. The brush assembly 564 is configured to contact the substrate 406 before the grind head 506 when the grind head 506 is lowered toward the substrate 406. Upon contacting the substrate 406, the brush assembly 564 pivots upward relative to the lower mount 518 until the pair of guides 546 contact the substrate 406.

Figure 7A:
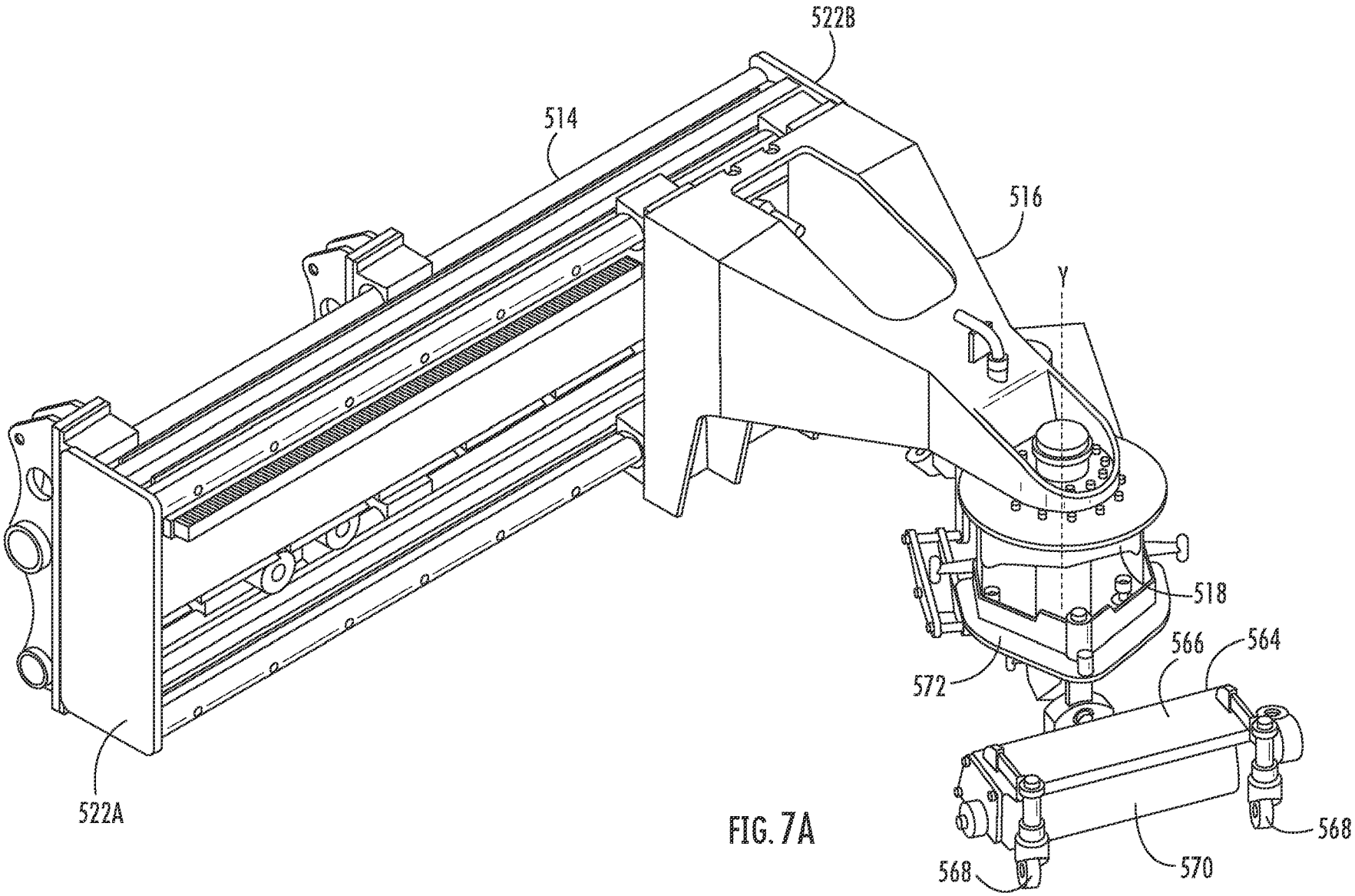
FIG. 7A is a perspective view of the grinding machine of FIGS. 5A-5D illustrating lateral translation and yaw of a grind head of the grinding machine relative to the upper mount of the grinding machine as the vehicle turns right.
Figure 7B:
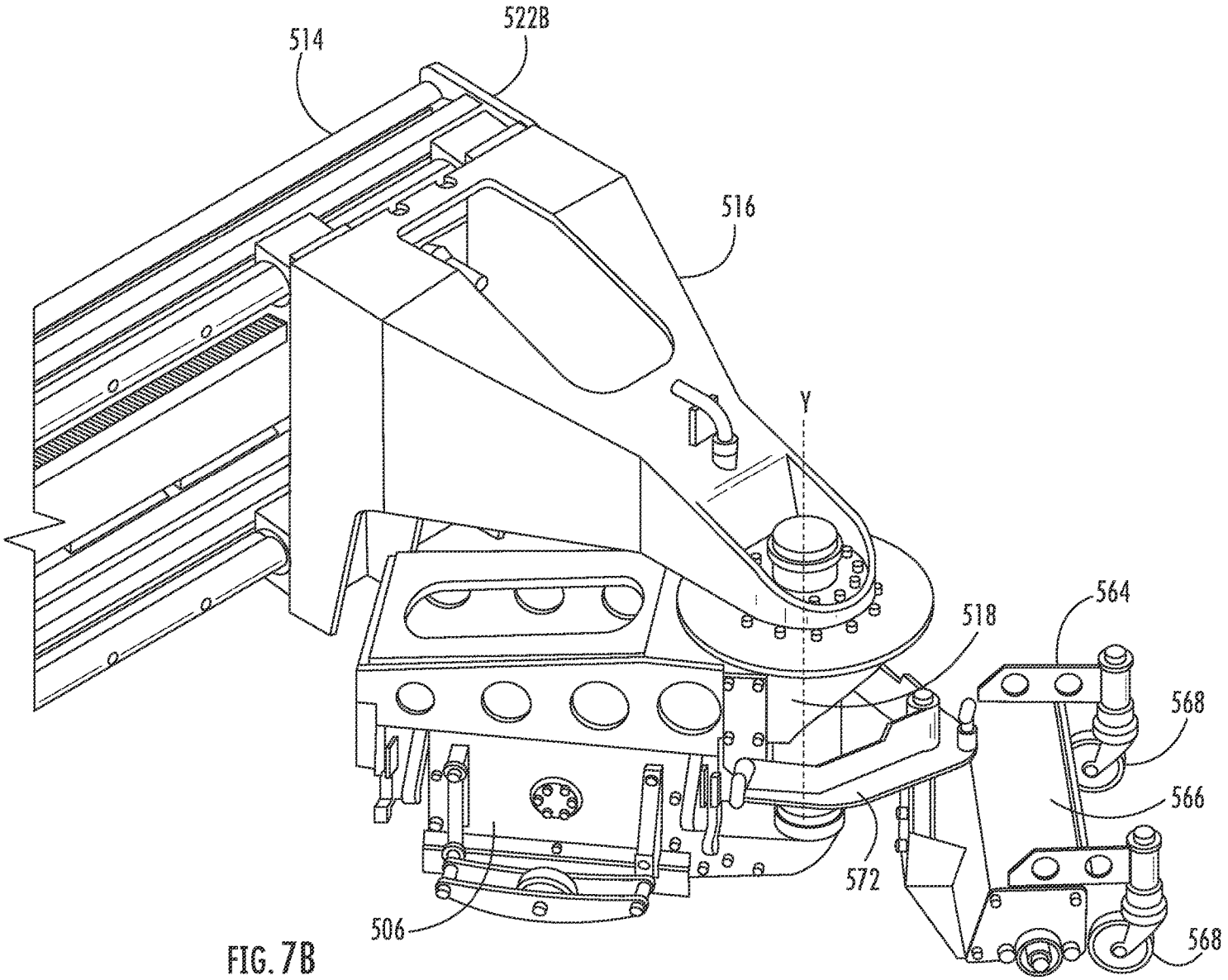
FIG. 7B is a perspective view of the grinding machine of FIG. 7B illustrating lateral translation and yaw of the grind head of the grinding machine relative to the upper mount of the grinding machine as the vehicle turns left.

FIGS. 7A-7B are perspective views of the grinding machine of FIGS. 5A-5D illustrating lateral translation and yaw of a grind head 506 of the grinding machine 502 relative to the upper mount 514 of the grinding machine 502 as the vehicle 500 turns. In particular, as illustrated, the intermediate mount 518 has moved laterally toward the side 522B of the upper mount 514. Accordingly, the grind head 506 has also moved laterally toward the side 522B of the upper mount 514.

Referring to FIG. 7A, as the vehicle 500 turns right, the lower mount 518 rotates about the yaw axis Y relative to the intermediate mount 516 about the caster mount 532. As a result, the grind head 506 and brush assembly 564 rotate about the yaw axis Y relative to the intermediate mount 516. Referring to FIG. 7B, as the vehicle 500 turns left, the lower mount 518 rotates about the yaw axis Y relative to the intermediate mount 516 about the caster mount 532. As a result, the grind head 506 and brush assembly 564 rotate about the yaw axis Y relative to the intermediate mount 516. In both scenarios, the grind head 506 moves underneath the intermediate mount 516.

Figure 8A:
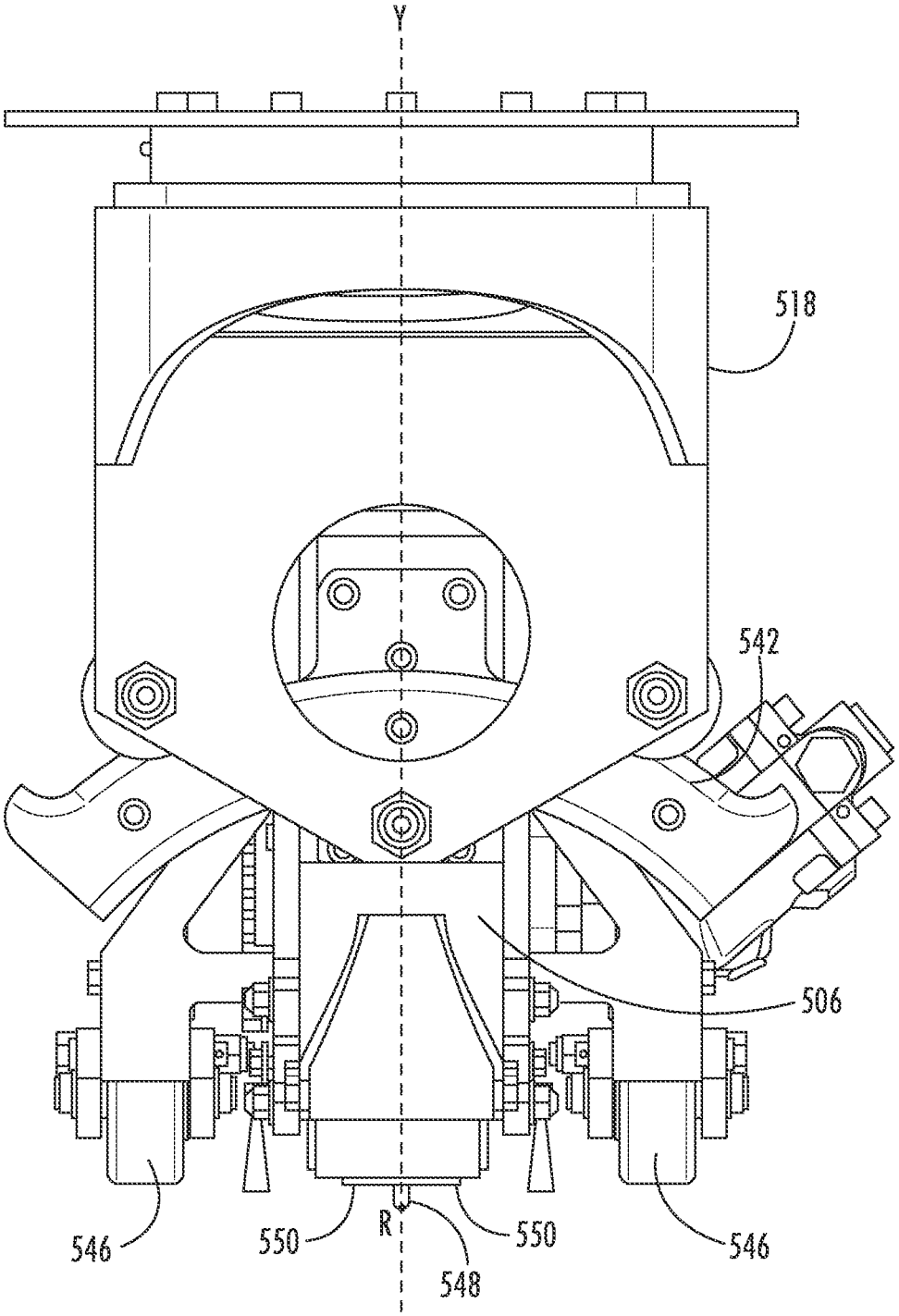
FIG. 8A is a front view of the grinding machine of FIGS. 5A-5D, illustrating a center position of the grind head of the grinding machine about a roll axis relative to the upper mount of the grinding machine.
Figure 8B:
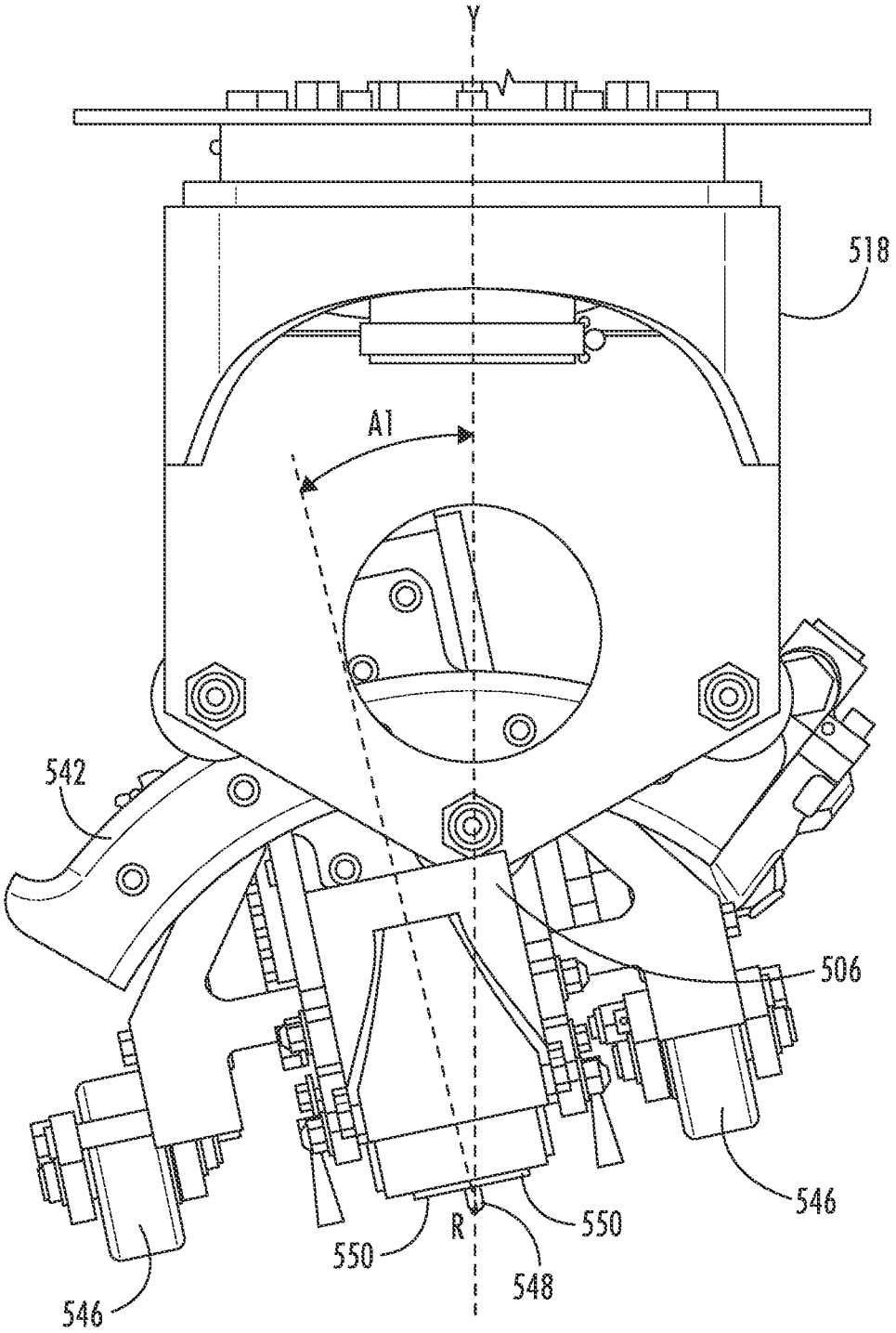
FIG. 8B is a front view of the grinding machine of FIG. 8A illustrating rotation of the grind head about the roll axis in a first direction.
Figure 8C:
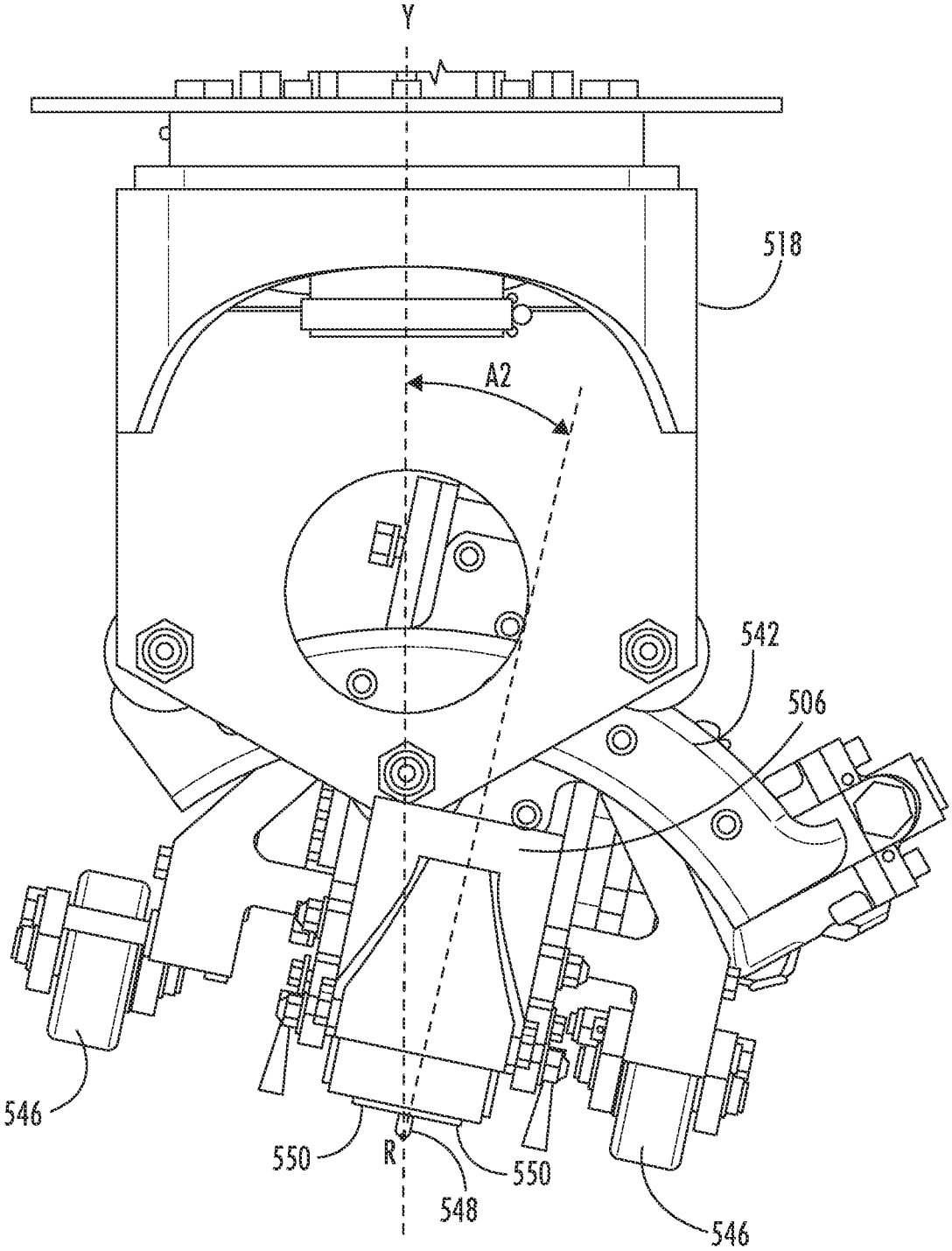
FIG. 8C is a front view of the grinding machine of FIG. 8A illustrating rotation of the grind head about the roll axis in a second direction.

FIGS. 8A-8C are views of the grinding machine 502 of FIGS. 5A-5D illustrating rotation of the grind head 506 of the grinding machine 502 about a roll axis relative to the upper mount 514 of the grinding machine 502. As noted above, the grind head 506 is mounted to the lower mount 518 by a trunnion 542. The trunnion 542 is arc-shaped with a curvature having a center point at the roll axis R. Accordingly, the grind head 506 rotates about the roll axis R in a first direction at a first angle A1 (from center) and in a second direction at a second angle A2 (from center).

As noted above, the roll axis R intersects at least a portion of the blade set 544. The roll axis R is proximate the channel blade 548, such as at an initial contact point at a lowest surface of the blade set 544. In particular, the initial contact point is at the lowest part of the channel blade 548 as that is the part of the blade set 544 that contacts the substrate 406 first. The trunnion 542 allows for the grind head 506 to remain in constant contact with the substrate 406 and to adapt to any lateral undulations in the substrate 406 between wheels 552 of the vehicle 500. This prevents any lateral motion of the channel blade 548, which might alter or affect the nano-trench 400, resulting in a more consistent and accurate grind.

The grinding machine 502 disclosed herein removes responsibility and dependence upon a vehicle operator for improved consistency and quality of the nano-trench 400. Further, the grinding machine 502 automates control of grind depth, feedback of grind wear, line tracking (for consistent grind path), and/or feedback for speed control, etc. In particular, the grinding machine 502 provides feedback to precisely control the geometry of the nano-trench 400, maximize grind speed, and/or minimize the amount of material removed. The grinding machine 502 prevents over-grinding, which can be a safety factor for pedestrian or bicycle traffic. The grinding machine 502 prevents under-grinding and/or prevents vulnerabilities in the cabling tape 412 and/or the fiber optic distribution cable. For example, exposure of the cabling tape 412 could make the cabling tape 412 and fiber optic distribution cable more susceptible to damage by turning traffic, snowplows, trailer end gates, etc.

The grinding machine 502 improves precision and/or accuracy for installation of fiber optic cables. In particular, the grinding machine 502 exerts an exact force, follows the contour of the crossroad and/or downroad contour, monitors grind depth, adjusts for blade wear, optimizes grind speed based on blade and/or nano-trench geometry, adjusts for differences in turning radius (relative to the grind path), and provides automatic control and/or feedback to reduce operator input and responsibility producing more consistent results. By providing a consistent grind, the cabling tape 412 over the distribution cable 410 is protected (e.g., from tire turns, snowplows, trailer tailgates, etc.), thereby making the fiber optic network more reliable and robust.

In accordance with yet other aspects of the present invention, an integrated primer sprayer apparatus for applying primer adhesive may be incorporated into the grinding machine 502. For example, a primer applicator of the type disclosed in U.S. Provisional Application Ser. No. 63/217,411, incorporated herein by reference, may be incorporated behind the grind head 506 to apply a primer adhesive into or around the ground trench almost immediately after the trench has been formed. A spray nozzle provided as part of the primer applicator may be used to direct to the primer toward the trench and/or a forced air blower may be provided such that the primer adhesive is directed into the air flow of the forced air blower and directed at the surface trenched by the grinding machine 502. When utilizing the blower, the primer is released into the air stream of the forced air device such that the combined primer and air fluid is propelled from the device exit at a fan out pattern and propelled to the pavement or surface being trenched. The rate of primer volume can be adjusted to match the speed of the grinding machine 502 as it moves during application. The air speed of the forced air device may remain constant and independent of the primer volume application (ml per minute). Any unevenness of primer volume is equalized across the grind recess at the final step. The final step is to apply additional air flow (e.g., 120 mph) to allow for the excess water in the primer to be evaporated and create a dry primer surface for subsequent application of a road adhesive tape.

By integrating as much functionality as possible into a single machine such as the grinding machine 502, installers of cable networks, such as fiber optic cable networks, can deploy cable more efficiently and with much less disruption to the environment and to those in the communities impacted. For example, by using a grinding machine 502 of the type disclosed in this application, alone or in combination with, for example, a cable and tape applicator machine of the type disclosed in U.S. patent application Ser. No. 16/927,248 or U.S. patent application Ser. No. 16/835,593, each of which are incorporated herein by reference, single flow-processes for roadway or surface installation of cable networks can be achieved. The grinding machine 502, for example, assists in efficient deployment by avoiding costly, long-term road closures (e.g., avoid cost of flaggers, detour trucks, etc.) and inconvenience to the community by providing for surface preparation (i.e., grind and/or primer application and/or drying) in a single pass that may be completed during one light cycle (typically a minimum of 30 secs but no more than two minutes, preferably 1 minute or less per cycle). In some scenarios, both the grinding machine 502 process and the cable and tape application process may be completed during a single light cycle or two light cycles (i.e., generally completed within one to four minutes). In another scenario, the grinding machine 502 may complete the grinding, priming, and/or blowing process during a first light cycle and the cable and tape application machine may complete the cable and tape installation during a second light cycle. In any scenario, the time, cost and disruption to the community are all substantially reduced during the efficient and effective installation of a cable network in a roadway or other hard surface scenario.

It will be apparent to those skilled in the art that various modifications and variations can be made without departing from the spirit or scope of the invention.

Further, as used herein, it is intended that terms "fiber optic cables" and/or "optical fibers" include all types of single-mode and multi-mode light waveguides, including one or more optical fibers that may be upcoated, colored, buffered, ribbonized, and/or have other organizing or protective structure in a cable such as one or more tubes, strength members, jackets or the like. Likewise, other types of suitable optical fibers include bend-insensitive optical fibers or any other expedient of a medium for transmitting light signals.

Many modifications and other embodiments of the concepts in this disclosure will come to mind to one skilled in the art to which the embodiments pertain, having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A grinding machine, comprising:

a grind head comprising:

a housing body;

a grinding drum comprising an axle and a blade set mounted thereto, the axle rotatably coupled to the housing body; and a vehicle mount attached to the housing body, the vehicle mount comprising a trunnion attachment configured to attach the housing body to a vehicle such that the housing body is configured to roll about a roll axis oriented in a travel direction relative to the vehicle mount, the roll axis proximate an initial contact point of the blade set.

2. The grinding machine of claim 1, wherein the roll axis intersects at least a portion of the blade set.

3. The grinding machine of claim 1, wherein the blade set comprises a channel blade and a plurality of milling blades on opposing sides of the channel blade; and wherein the roll axis is proximate the channel blade.

4. The grinding machine of claim 1, wherein the initial contact point is at a lowest surface of the blade set.

5. The grinding machine of claim 1, wherein the vehicle mount includes an upper mount attached to the lower mount, the upper mount configured to vertically translate the housing body relative to the vehicle.

6. The grinding machine of claim 1, wherein the vehicle mount includes an intermediate mount attaching the lower mount to the upper mount, the intermediate mount configured to laterally translate relative to the upper mount.

7. The grinding machine of claim 1, further comprising a roller brush positioned frontward of the housing body.

8. The grinding machine of claim 1, further comprising a pair of guides on opposing sides of the blade set, each of the pair of guides axially aligned with the grinding drum.

9. The grinding machine of claim 1, wherein the blade set comprises at least one polycrystalline diamond-tipped blade.

10. The grinding machine of claim 1, further comprising at least one sensor positioned frontward of the grinding drum to determine lateral deviation from a predetermined grind path.

11. A grinding machine, comprising:

a grind head comprising:

a housing body;

a grinding drum comprising an axle and a blade set mounted thereto, the axle rotatably coupled to the housing body; and a vehicle mount attached to the housing body, the vehicle mount comprising a caster attachment configured to attach the housing body to a vehicle such that the housing body is configured to yaw about a yaw axis oriented in an upward direction relative to the vehicle mount.

12. The grinding machine of claim 11, wherein the yaw axis is at a front of the housing body.

13. The grinding machine of claim 11, wherein the housing body is configured to freely rotate about the caster attachment.

14. The grinding machine of claim 11 further comprising a vacuum tube, wherein a portion of the vacuum tube extends through a center of the caster mount.

15. The grinding machine of claim 11, wherein the vehicle mount includes an upper mount attached to the lower mount, the upper mount configured to vertically translate the housing body relative to the vehicle.

16. The grinding machine of claim 11, wherein the vehicle mount includes an intermediate mount attaching the lower mount to the upper mount, the intermediate mount configured to laterally translate relative to the upper mount.

17. The grinding machine of claim 11, further comprising a roller brush positioned frontward of the housing body.

18. The grinding machine of claim 11, further comprising a pair of guides on opposing sides of the blade set, each of the pair of guides axially aligned with the grinding drum.

19. The grinding machine of claim 11, wherein the blade set comprises at least one polycrystalline diamond-tipped blade.

20. The grinding machine of claim 11, further comprising at least one sensor positioned frontward of the grinding drum to determine lateral deviation from a predetermined grind path.

* * * * *